US009045946B2

(12) United States Patent
Krueger

(10) Patent No.: US 9,045,946 B2
(45) Date of Patent: Jun. 2, 2015

(54) APPARATUS AND METHOD FOR DRILLING WELLBORES

(75) Inventor: Sven Krueger, Niedersachsen (DE)

(73) Assignee: Baker Hughes Incorporated, Houston, TX (US)

( * ) Notice: Subject to any disclaimer, the term of this patent is extended or adjusted under 35 U.S.C. 154(b) by 783 days.

(21) Appl. No.: 13/240,212

(22) Filed: Sep. 22, 2011

(65) Prior Publication Data

US 2012/0073876 A1 Mar. 29, 2012

Related U.S. Application Data

(60) Provisional application No. 61/385,633, filed on Sep. 23, 2010.

(51) Int. Cl.
*E21B 7/20* (2006.01)
*E21B 4/18* (2006.01)

(52) U.S. Cl.
CPC ..... *E21B 4/18* (2013.01)

(58) Field of Classification Search
CPC ..... E21B 7/20
USPC ..... 175/94, 61, 171, 45, 385, 257, 259, 175/262, 57
See application file for complete search history.

(56) References Cited

U.S. PATENT DOCUMENTS

| | | | | |
|---|---|---|---|---|
| 2,764,388 | A * | 9/1956 | Camp | 175/259 |
| 4,060,141 | A | 11/1977 | Catterfeld | |
| 6,196,336 | B1 * | 3/2001 | Fincher et al. | 175/101 |
| 6,419,033 | B1 * | 7/2002 | Hahn et al. | 175/61 |
| 2002/0050359 | A1 | 5/2002 | Eddison | |
| 2002/0112859 | A1 * | 8/2002 | Bloom et al. | 166/381 |
| 2004/0140128 | A1 * | 7/2004 | Vail, III | 175/57 |
| 2009/0057015 | A1 | 3/2009 | Treviranus et al. | |

FOREIGN PATENT DOCUMENTS

EP 1006260 A2 6/2000

OTHER PUBLICATIONS

International Search Report and The Written Opinion of the International Searching Authority, or the Declaration for International Application No. PCT/US2011/052955; (May 2012).

* cited by examiner

*Primary Examiner* — David Andrews
*Assistant Examiner* — Ronald Runyan
(74) *Attorney, Agent, or Firm* — Cantor Colburn LLP

(57) ABSTRACT

In an aspect, an apparatus for use in a wellbore includes a tubular and a drilling assembly configured to carry a drill bit at an end thereof, wherein the drilling assembly is configured to be positioned within the tubular, wherein the tubular and drilling assembly are configured to be run in the wellbore together. The apparatus also includes an actuation device in the tubular configured to selectively extend the drilling assembly from and retract the drilling assembly into the tubular.

11 Claims, 3 Drawing Sheets

APPARATUS AND METHOD FOR DRILLING WELLBORES

CROSS-REFERENCE TO RELATED APPLICATIONS

This application takes priority from U.S. Provisional application Ser. No. 61/385,633, filed on Sep. 23, 2010, which is incorporated herein in its entirety by reference.

BACKGROUND

1. Field of the Disclosure

This disclosure relates generally to apparatus and methods for drilling wellbores.

2. Background of the Art

Oil wells (also referred to as "wellbores") are drilled with a drill string that includes a tubular member having a drilling assembly with a drill bit at its bottom end. The tubular member is generally either a jointed pipe or coiled tubing. After the well or a section of the wellbore has been drilled, it is lined with a casing (also referred to as the liner). However, sometimes the liner is placed outside a portion of the drill string while drilling and may include a second drill bit, referred to as the reamer drill bit or reamer, above or uphole of the drill bit at the drilling assembly bottom (also referred to as the "pilot" drill bit). The pilot drill bit drills a bore with a certain diameter and the reamer enlarges this bore to the desired wellbore diameter. As the liner and pilot drill bit enter an unstable formation, the wellbore may collapse, causing damage to the portions of the drill string and drill bit located outside of the liner.

SUMMARY

In an aspect, an apparatus for use in a wellbore includes a tubular and a drilling assembly configured to carry a drill bit at an end thereof, wherein the drilling assembly is configured to be positioned within the tubular, wherein the tubular and drilling assembly are configured to be run in the wellbore together. The apparatus also includes an actuation device in the tubular configured to selectively extend the drilling assembly from and retract the drilling assembly into the tubular.

A method of drilling a wellbore includes conveying a tubular containing a drill string into a wellbore, the drill string including a drilling assembly axially movable within the tubular. The method also includes selectively retracting the drilling assembly into and extending the drilling assembly from the tubular during drilling of the wellbore.

Certain features of the apparatus and methods disclosed herein are summarized herein rather broadly in order that the detailed description thereof that follows may be better understood. There are, of course, additional features of the apparatus and methods disclosed that will become part of this disclosure.

BRIEF DESCRIPTION OF THE DRAWINGS

For detailed understanding of the present disclosure, references should be made to the following detailed description, taken in conjunction with the accompanying drawings, in which like elements have generally been given like numerals and wherein.

DETAILED DESCRIPTION

Figure 1:
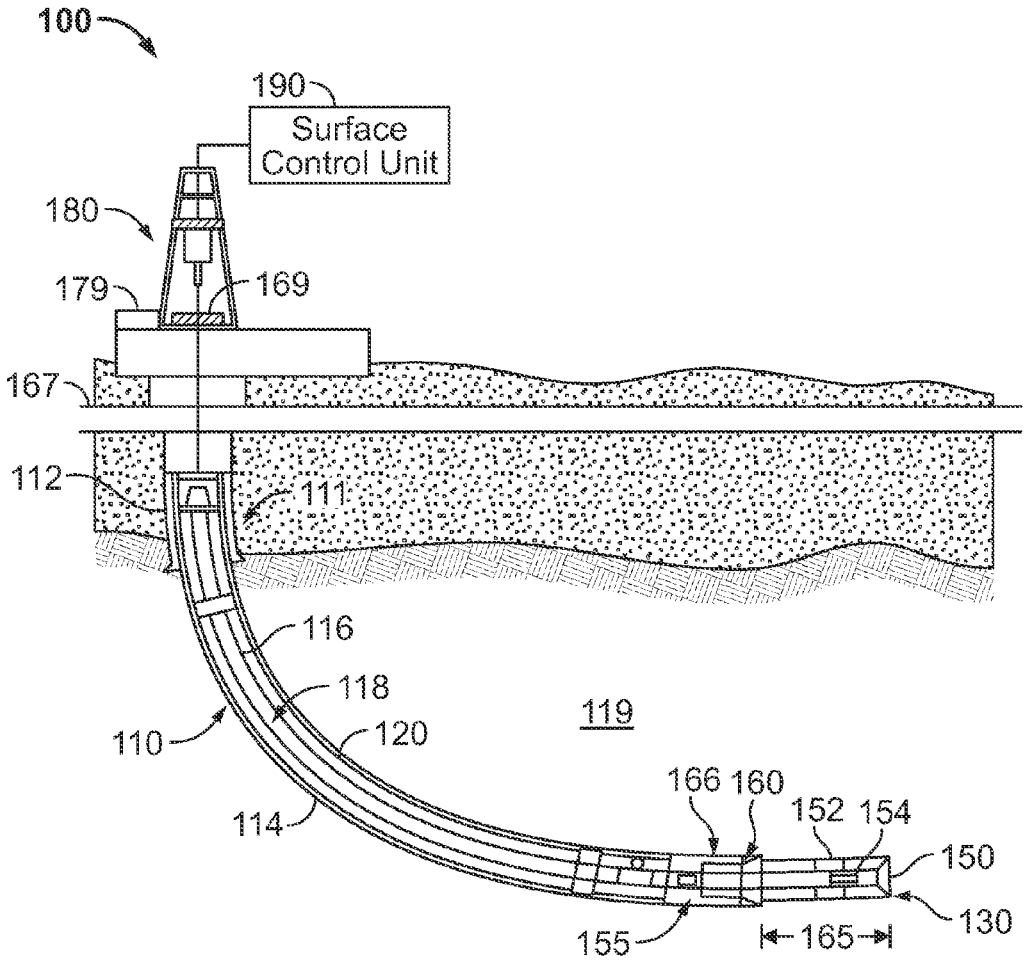
FIG. 1 is a schematic diagram of a wellbore system showing drilling of a wellbore with a drill string that includes a drilling assembly, a drill bit and a liner made according to one embodiment of the disclosure.

FIG. 1 is a schematic diagram showing a drilling system 100 for drilling wellbores according to one embodiment of the present disclosure. FIG. 1 shows a wellbore 110 that includes an upper section 111 with a casing 112 installed therein, and a lower section 114 being drilled with a drill string 118. The drill string 118 includes a tubular member 116 that carries a drilling assembly 130 (also referred to as a "borehole assembly" or "BHA") at its bottom end. The tubular member may be made up by joining drill pipe sections. A drill bit 150 (also referred to herein as the "pilot bit") is attached to the bottom end of the drilling assembly 130 for drilling a bore in the formation 119 of a first diameter. A liner 120 is placed outside the drilling tubular 116. As shown, the drill bit 150 is configured to stick out a selected length 165 (a "stick out length") from the liner 120. A second drill bit 160 (also referred to herein as the "reaming bit" or "reamer") is disposed on the liner 120 and around a section of the drill string 130 above or uphole of the pilot bit 150. An actuation device 155 is located in a downhole liner portion 166, wherein the actuation device 155 is configured to selectively extend and retract the drilling assembly 130 and the pilot bit 150. The operation of the actuation device 155, drilling assembly 130 and pilot bit 150 is described later with reference to FIGS. 2-4.

In one aspect, the drilling assembly 130 includes a steering device 152, such as steering ribs or pads, and a measurement device 154, such as formation evaluation tools and measurements while drilling ("MWD") sensors. The drill string 118 extends to a rig 180 at the surface 167. A rotary table 169 or a top drive (not shown) may be utilized to rotate the drill string 118 and thus the drilling assembly 130 and the pilot bit 150. A control unit 190, which may be a computer-based unit, is placed at the surface 167 for receiving and processing downhole data transmitted by the drilling assembly 130 and for controlling operations of the various devices and sensors in the drilling assembly 130. The controller 190 may include a processor, a storage device for storing data and computer programs. The processor accesses the data and programs from the storage device and executes the instructions contained in the programs to control the drilling operations. A drilling fluid 179 from a source thereof is pumped under pressure through the drilling tubular 116. The drilling fluid 179 discharges at the bottom of the pilot bit 150 and returns to the surface via an annulus between the drill string 118 and the wellbore 110.

Figure 2:
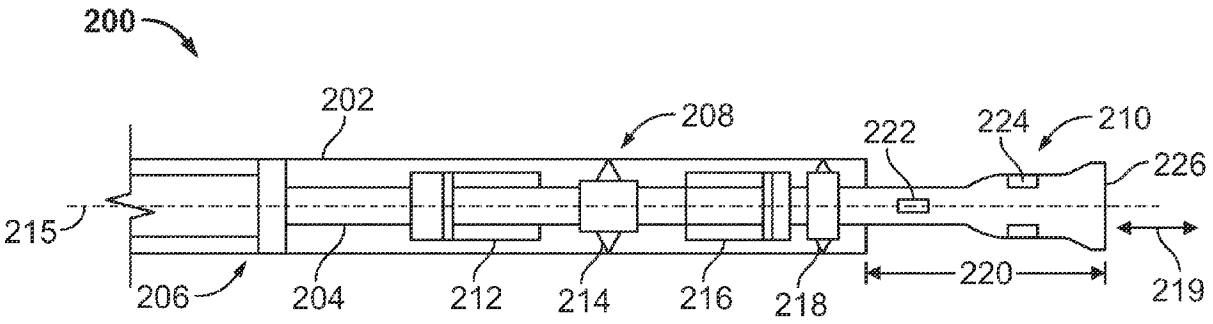
FIG. 2 shows a schematic diagram of a drilling assembly, actuation device and liner made according to one embodiment of the disclosure.

FIG. 2 shows a schematic diagram of an embodiment of a portion 200 of a tubular (liner or outer member) 202 and a drill string 204. In one aspect, the tubular 202 and drill string 204 are conveyed together into the formation by a run-in tool 206. An actuation device 208 is located within a portion of the tubular 202 to selectively extend and retract a drilling assembly 210 from an end of the tubular 202. In one configuration, the actuation device 208 includes a thruster 212 and a gripper 214 (also referred to as "locking mechanism") configured to move the drilling assembly 210 relative to the tubular 202. In another configuration, one or more additional thruster and gripper combinations, such as thruster 216 and gripper 218, may be utilized to increase the stroke length of the actuator device 208. The exemplary thrusters 212 and 216 are linear actuators, such as hydraulic cylinders, configured to move the drilling assembly 210 along axis 215. Thrusters 212 and 216, in one aspect, compress and pressurize fluid, such as drilling fluid, to cause axial extension and retraction of the drilling assembly in the tubular, as shown by arrows 219. The axial movement 219 of the actuation device 208 causes a change in distance 220, also referred to herein as "stick out length." The stick out length is an indicator of the portion of the drilling assembly 210 that is exposed or not contained within the tubular 202. The drilling assembly 210 includes sensor and evaluation devices 222, steering devices 224 and drill bit 226. The sensor and evaluation devices 222 may include formation evaluation ("FE") tools as well as sensors for measurements-while-drilling ("MWD"). In an aspect, the formation evaluation tools include gamma ray and resistivity sensors, which are relatively expensive and to replace and repair, if damaged. The drill bit 226 may be any suitable tool for creating a borehole in a formation, such as roller cone bit, PDC bit or reamer. The actuation device 208 may be configured to retract a portion or substantially entirely all of the drilling assembly 210 within the tubular 202 downhole, such as when positioned in unstable formations. Accordingly, by retracting and positioning the drilling assembly 210 within the tubular 202, the sensor and evaluation devices 222, steering devices 224 and drill bit 226 are protected from damage during a collapse of the formation.

Still referring to FIG. 2, the actuation device 208 includes grippers 214 and 218 configured to engage and disengage the inner walls of liner 202, thereby enabling the thrusters 212 and 216 to be released or locked in a selected position or state of actuation (extension or retraction) and to control axial movement in the actuation device 208. The grippers 214 and 218 (locking mechanisms) may be any suitable mechanical, hydraulic and/or electrical device that couples, locks or engages the actuation device 208 to the inner wall of the tubular 202. An example of the operation of actuation device 208 follows. The grippers 214 and 218 disengage from the liner 202 to enable the first thruster 212 to fully extend. The first gripper 214 then engages the liner 202 to "lock" the extended position of the first thruster 212 in place. Thus, for further extension of the drilling assembly 210, the second gripper 218 is disengaged while second thruster 216 is extended to a desired position. The second gripper 218 then engages the liner 202 to secure or "lock" the position of drilling assembly 210, causing a selected stick out length 220 from the liner 202. In addition, the grippers 214 and 218 are configured to lock the thrusters (212, 216) in selected positions to relieve pressure from the thrusters while the distance 220 remains substantially the same.

Figure 3:
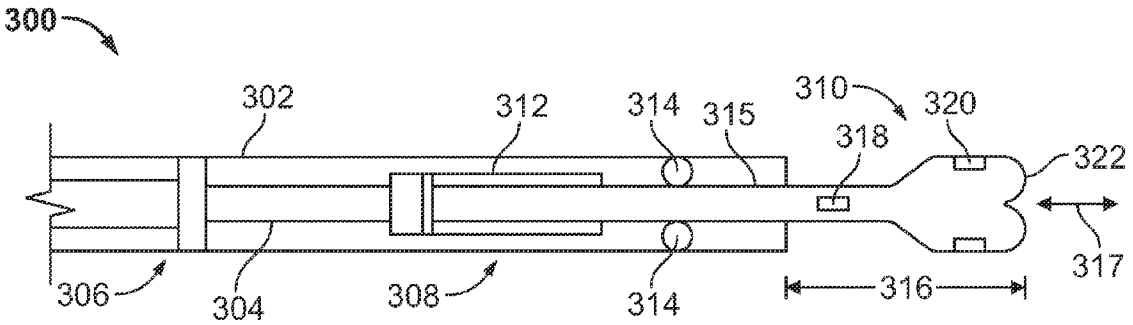
FIG. 3 shows a schematic diagram of a drilling assembly, actuation device and liner made according to one embodiment of the disclosure.

FIG. 3 shows a schematic diagram of another embodiment of a portion 300 of a tubular 302 and drill string 304. In one aspect, the tubular 302 and drill string 304 are conveyed together into the wellbore by a run-in tool 306. An actuation device 308 is located within a portion of the tubular 302 (or "liner") to selectively extend and retract a drilling assembly 310 from an end of the tubular 302. The actuation device 308 includes a thruster 312 and tractors 314. As depicted, the thruster 312 is a mechanical, electronic, electromechanical or hydraulic linear actuator, such as a hydraulic cylinder or ball screw mechanism described above. In one aspect, the tractors 314 are mechanisms that utilize rotating radial members which grip or contact the inner walls (or "chamber walls") of the tubular 302 and therefore guide and axially convey tubing 315 (or "tubular", "drill string portion" or "drilling assembly tubular") in and out of the tubular 302. Tractors 314 may be any suitable reliable and powerful mechanism to guide movement of the drilling assembly 310 and cause axial movement, such as a mechanical, electronic, electromechanical and/or hydraulic mechanism. The tractors 314 may also provide locking of the drilling assembly 310 in a selected extended or retracted position. In an embodiment, thruster 312 and/or tractors 314 cause axial extension and retraction of the drilling assembly 310, as shown by arrows 317. The axial movement 317 of the actuation device 308 causes the drilling assembly 304 to extend beyond the tubular 302, such as shown by the distance 316, also referred to as "stick out length." The stick out length is an indicator of the portion of the drilling assembly 310 that is not contained within the tubular 302. The drilling assembly 310 includes sensor and evaluation devices 318, steering devices 320 and drill bit 322. The sensor and evaluation devices 318 may include FE tools as well as MWD sensors. In one embodiment, the tractors 314 supply the majority of actuating force to cause movement 317, where the thruster 312 maintains substantial axial alignment of the drilling assembly 310 and tubing 315 with the tubular 302. In another embodiment, the tractors 314 and thruster 312 may each provide axial force or power for movement 317 of the drilling assembly 310. It should be noted that one or more thrusters 312 and/or tractors 314 may be used to control the position of and actuate the axial movement of the drilling assembly 310. Further, additional components, such as grippers, may also be included to facilitate operation of actuation device 308.

Figure 4:
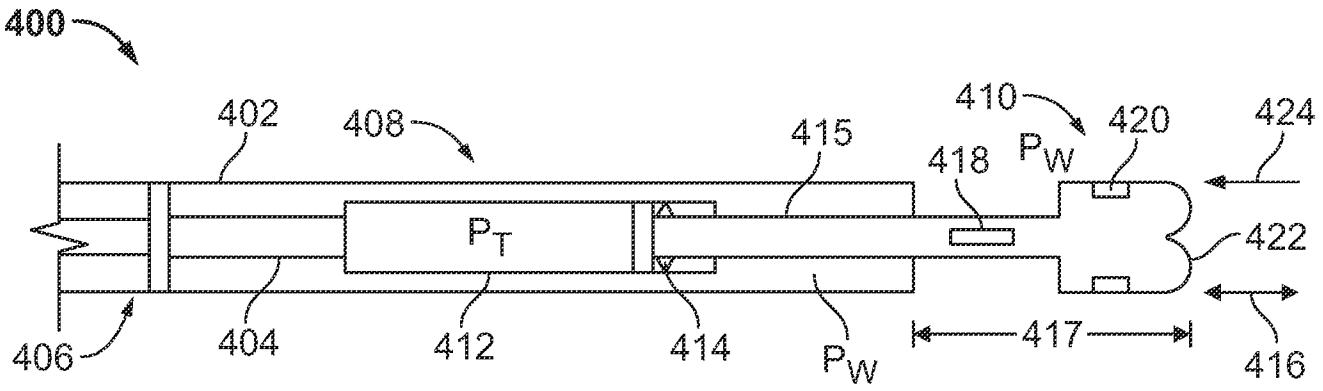
FIG. 4 shows a schematic diagram of a drilling assembly, actuation device and liner made according to one embodiment of the disclosure.

FIG. 4 shows a schematic diagram of yet another embodiment of a portion 400 of a tubular 402 and drill string 404. In one aspect, the tubular 402 (or "liner") and drill string 404 are conveyed together into the formation by a run-in tool 406. An actuation device 408 is located within a portion of the tubular 402 to selectively extend and retract a drilling assembly 410 from an end of the tubular 402. The actuation device 408 includes a thruster 412 and locks 414. As depicted, the thruster 412 is a mechanical, electronic, electromechanical or hydraulic linear actuator, such as a hydraulic cylinder or ball screw mechanism. In one aspect, the locks 414 (also referred to as "locking mechanism") are a mechanism configured to secure and maintain a position of a tubular 415 within the thruster 412. Locks 414 (or "locking mechanisms") may be any suitable mechanism, such as a mechanical, electronic, electromechanical and/or hydraulic mechanism, configured to engage and disengage (lock or release) the position of tubular 415 within the thruster 412. In aspects, thruster 412 has a selected pressure $P_T$ inside the thruster chamber, while a wellbore pressure $P_W$ is outside the sealed chamber. The thruster pressure $P_T$ may be controlled and configured depending on several parameters and conditions, including distance downhole and formation characteristics. In an exemplary embodiment, the distance downhole (or "borehole length") is proportional to the wellbore pressure $P_W$, where the difference between thruster pressure $P_T$ and wellbore pressure $P_W$ controls axial movement 416 of the actuation device 408 and, therefore, drilling assembly 410. The axial movement 416 of the actuation device 408 causes a change in distance 417, also referred to as "stick out length." The stick out length 417 is an indicator of the portion of the drilling assembly 410 that protrudes from the tubular 402. The drilling assembly 410 includes sensor and evaluation devices 418, steering devices 420 and drill bit 422. The sensor and evaluation devices 418 may include FE tools as well as MWD sensors. The steering devices 420 may include hydraulically, mechanically and/or electrically actuated members, such as ribs or pads, to control a drilling direction of the drilling assembly 410.

One example of the operation of the actuation device 408 is as follows. The thruster pressure $P_T$ is maintained at a substantially greater pressure than wellbore pressure $P_W$, where the pressure difference causes an axial force to extend thruster 412 and drilling assembly 410. In an embodiment, there is substantially minimal or no weight-on-bit when the thruster pressure $P_T$ causes extension of the drilling assembly 410. The locks 414 are disengaged from the chamber walls of thruster 412, enabling the axial force to cause the drilling assembly 410 to extend or protrude from the tubular 402. As the drilling assembly 410 reaches a desired stick-out-length 417, the locks 414 secure and engage the chamber walls (or "inner walls") to prevent further extension of the drilling assembly 410 by the axial force caused by the pressure difference. Thus, the actuation device 408 is configured to manipulate or utilize the pressure difference ($P_T$–$P_W$), thruster 412 and locks 414 to control axial movement and stick-out-length 417 of drilling assembly 410. In an aspect, stick-out-length 417 is reduced and drilling assembly 410 is retracted by causing an increase in weight-on-bit 424 ("WOB") force to overcome $P_T$ while the locks 414 are disengaged from the chamber walls. The increased WOB may be caused at the surface by a mechanism, such as a rotary table. In one embodiment, the thruster pressure $P_T$ is controlled by adjusting the amount of drilling fluid contained in the thruster 412. The thruster pressure $P_T$, wellbore pressure $P_W$ and corresponding pressure differential may be maintained and measured using pressure sensors positioned in the drill string, such as in the thruster 412 and the drilling assembly 410. In an embodiment, a second chamber of the thruster 412 may be pressurized to cause the drilling assembly to retract and reduce the stick-out-length 417, wherein the second chamber is on an opposite side of the piston 450 as the thruster chamber. In embodiments, the drilling assemblies 210, 310, 410 are run-in downhole with the tubulars 202, 302, 402, wherein the tubulars may be liners or casing that protect the drilling assemblies from damage in unstable formations.

While the foregoing disclosure is directed to certain embodiments, various changes and modifications to such embodiments will be apparent to those skilled in the art. It is intended that all changes and modifications that are within the scope and spirit of the appended claims be embraced by the disclosure herein.

What is claimed is:

1. An apparatus for use in a wellbore, comprising:

a tubular;

a drilling assembly configured to carry a drill bit at an end thereof, wherein the drilling assembly is configured to be positioned within the tubular, wherein the tubular and drilling assembly are configured to be run in the wellbore together; and an actuation device in the tubular configured to selectively extend the drilling assembly from and retract the drilling assembly into the tubular a desired distance, wherein the actuation device comprises a locking mechanism configured to couple the drilling assembly to the tubular at the desired distance, and a thruster, wherein a pressure within a chamber of the thruster greater than a wellbore pressure causes the drilling assembly to extend when the locking device is released.

2. The apparatus of claim 1, wherein the actuation device is configured to retract the drilling assembly substantially entirely within the tubular.

3. The apparatus of claim 1, wherein the actuation device comprises a tractor coupled to the drilling assembly and the tubular to guide the drilling assembly in the tubular.

4. The apparatus of claim 3, wherein the tractor provides a force to assist in extending and retracting the drilling assembly.

5. The apparatus of claim 1, wherein the drilling assembly comprises a formation evaluation and measurement tool configured to be positioned within the tubular when the drilling assembly is retracted.

6. The apparatus of claim 1, wherein the drilling assembly is configured to retract when the locking device is released and a selected weight is applied to the drilling assembly.

7. A method of drilling a wellbore, comprising:

conveying a tubular containing a drill string into a wellbore, the drill string including a drilling assembly axially movable within the tubular;

selectively extending the drilling assembly from the tubular a desired distance by pressurizing a chamber of a thruster to pressure greater than a wellbore pressure; and coupling the drilling assembly to the tubular at the desired distance while the drilling assembly and the tubular are disposed in the wellbore to drill the wellbore.

8. The method of claim 7, wherein selectively extending the drilling assembly from and retracting the drilling assembly into the tubular comprises selectively extending and retracting using a tractor coupled to the drilling assembly and the tubular.

9. The method of claim 7, wherein selectively extending the drilling assembly from and retracting the drilling assembly into the tubular comprises selectively retracting a formation evaluation and measurement tools in the drilling assembly within the tubular.

10. The method of claim 7, wherein the drilling assembly includes a locking device to allow the drilling assembly to extend when the locking device is released.

11. The method of claim 10, further comprising;

retracting the drilling assembly into the tubular by releasing the locking device and applying one of a selected weight on the drilling assembly and a pressure to a retracting chamber of the thruster.

* * * * *